US011910933B2

(12) United States Patent
Works

(10) Patent No.: US 11,910,933 B2
(45) Date of Patent: Feb. 27, 2024

(54) FLIP CUSHION CHAIR

(71) Applicant: Elite Outdoor, Inc, Mooresville, NC (US)

(72) Inventor: Donald Works, Cornelius, NC (US)

(73) Assignee: Elite Outdoor, Inc., Mooresville, NC (US)

( * ) Notice: Subject to any disclaimer, the term of this patent is extended or adjusted under 35 U.S.C. 154(b) by 81 days.

(21) Appl. No.: 17/101,851

(22) Filed: Nov. 23, 2020

(65) Prior Publication Data

US 2022/0160130 A1 May 26, 2022

(51) Int. Cl.
*A47C 7/02* (2006.01)
*A47C 7/42* (2006.01)

(52) U.S. Cl.
CPC ..... *A47C 7/021* (2013.01); *A47C 7/425* (2013.01)

(58) Field of Classification Search
CPC ..... A47C 7/021; A47C 7/425; A47C 4/02; A47C 4/028
USPC ..... 297/283.2
See application file for complete search history.

(56) References Cited

U.S. PATENT DOCUMENTS

| | | | | |
|---|---|---|---|---|
| 3,874,729 | A * | 4/1975 | Blodee | A47C 7/185 297/448.2 |
| 5,816,649 | A * | 10/1998 | Shields | A47B 21/06 297/162 |
| 10,188,211 | B1 * | 1/2019 | Whidden | A47C 1/124 |
| 2008/0036266 | A1 * | 2/2008 | Battey | A47C 5/12 297/440.21 |
| 2010/0176633 | A1 * | 7/2010 | Brncick | B60N 2/585 297/228.11 |
| 2016/0037928 | A1 * | 2/2016 | Cali, Sr. | A47C 5/12 297/135 |
| 2020/0196751 | A1 * | 6/2020 | Wong | A47C 4/03 |
| 2020/0237098 | A1 * | 7/2020 | VandenBos | A47C 9/00 |
| 2021/0307537 | A1 * | 10/2021 | Colondona | A47C 7/425 |

* cited by examiner

*Primary Examiner* — Mark R Wendell
(74) *Attorney, Agent, or Firm* — GableGotwals; David G. Woodral

(57) ABSTRACT

The invention relates to outdoor furniture having a seat cushion having a cover material on the bottom and back sides so that the seat cushion that can be turned over and flipped front to back to protect the cushion from weather outdoors. The frame includes a seat pan support for supporting a seat assembly. The seat cushion assembly has a cushioned first surface and a covered second surface. In use, the seat cushion assembly may be configured for protection or may be configured for seating by a user by flipping the seat cushion assembly over and by flipping the seat cushion assembly from front to back.

15 Claims, 10 Drawing Sheets

FLIP CUSHION CHAIR

FIELD OF THE INVENTION

The invention of the application relates to outdoor furniture. More particularly, the invention relates to outdoor furniture having cushions, wherein the furniture can be configured in either a seating configuration or a weather protection configuration in which the cushions are protected from exposure to weather.

BACKGROUND OF THE INVENTION

Outdoor furniture is commonly used by homeowners. Outdoor furniture has traditionally been constructed of hard materials that are able to withstand weather elements but that tend to be uncomfortable for users. Alternatively, outdoor furniture has been designed for use with cushions. Cushions for outdoor furniture may be constructed of materials designed to withstand weather elements. However, unless the cushions are removed from the furniture and stored indoors or otherwise protected from the weather when not in use, cushions can get wet and dirty from exposure to the elements. Even the best cushions can degrade due to weather exposure. Nevertheless, users typically leave cushions on outdoor furniture for extended lengths of time to avoid the hassle of moving and storing the cushions elsewhere. Consequently, typical outdoor furniture cushions tend to get dirty and dusty, which may deter use.

SUMMARY OF THE INVENTION

The invention relates to furniture for outdoor seating such as chairs, love seats, sofas, or other furniture having a seat cushion having a cover on the bottom and back sides so that the seat cushion that can be turned over and flipped front to back to protect the cushion from weather outdoors.

In greater detail, the flip-cushion furniture of the invention includes a frame, wherein the frame may be constructed using steel, aluminum, wood, vinyl, nylon, plastics or any combination of these materials. The frame includes a seat pan support for supporting a seat assembly. The frame may have framing on the sides, front or back of the seat area. A seat pan support is provided on the frame on which a seat assembly sits, but to which the seat cushion assembly is preferably not attached to facilitate ease of flipping the seat cushion assembly. Preferably, the frame defines a cushion receiving receptacle beneath the seat pan support. The cushion receiving receptacle is preferably sized to receive a back cushion.

The seat cushion assembly has a first surface and a second surface. The first surface of the seat assembly has a seat cushion and the second surface of the seat assembly has an inner frame or first seat pan section. The cover may be permanently attached or removable to an outside of the second surface. In one embodiment, the cover is a weather resistant material. The seat cushion assembly may have handles or ties or toggles that make flipping over the seat cushion easier.

A seat area of the frame must be sized to accommodate the seat cushion assembly. The seat cushion assembly must be able to sit securely on a support structure provided on the sides, front, and/or back of the seat area, but still move freely enough to be easily flipped over.

The seat cushion assembly may include steel, aluminum, wood, vinyl, plastics, polyester, olefin, acrylic, cotton, foam, metal zippers, plastic zippers, or any combination of these materials.

The cushions may be constructed using polyester, olefin, acrylic, cotton, nylon, plastics, foam, metal zippers, plastic zippers, or any combination of these materials.

In use, the furniture may be configured for cover protection by grasping the seat cushion assembly that is supported by the frame, wherein the seat cushion assembly is oriented with a first side with a seat cushion facing upwardly and second surface having a cover facing downwardly. Additionally, the seat cushion assembly has first cushioned side surface facing outwardly and a second side cover surface facing a back portion of the frame. The seat cushion assembly is lifted to expose a cushion receiving receptacle in the frame and the back cushion is located into the cushion receiving receptacle.

The seat cushion assembly is flipped over and is flipped front to back and located on the seat pan support, wherein the previously upwardly facing cushioned first surface is oriented in a downwardly facing orientation and wherein the previously outwardly facing cushioned first side surface is oriented to face the back portion of said frame. Consequently, a cover surface is upwardly and outwardly facing and the cushioned surfaces are protected beneath the cover surface.

The furniture can be re-configured into a seating configuration by grasping the seat cushion assembly and lifting the seat cushion assembly to expose the back cushion in the cushion receiving receptacle. The back cushion is removed from the cushion receiving receptacle.

The seat assembly is flipped over and is flipped front to back such that the cushioned first surface if facing upwardly and the cushioned first side surface is facing outwardly.

The seat cushion assembly must sit securely on the support structure provided on the sides, front, and/or back of the seat area of the frame so that the furniture of the invention has the strength required for use. The seat cushion assembly must be able to support weight, withstand repeated impact of weight, etc. Preferably, the support structure provided under the seat cushion assembly is permanently attached to the frame. However, a structure may be provided under the seat cushion assembly that drops in place. The frame is preferably provided with arms. However, the frame of the invention may be constructed without arms.

The furniture of the invention protects furniture cushions by helping to keep cushions more clean and more dry.

The furniture of the invention may be a chair, love seat, lounger, recliner, sofa, couch, settee, chaise, stool, bar stool, bench, daybed, armless chair, sectional, futon, or other furniture.

DETAILED DESCRIPTION OF THE PREFERRED EMBODIMENTS

Figure 1:
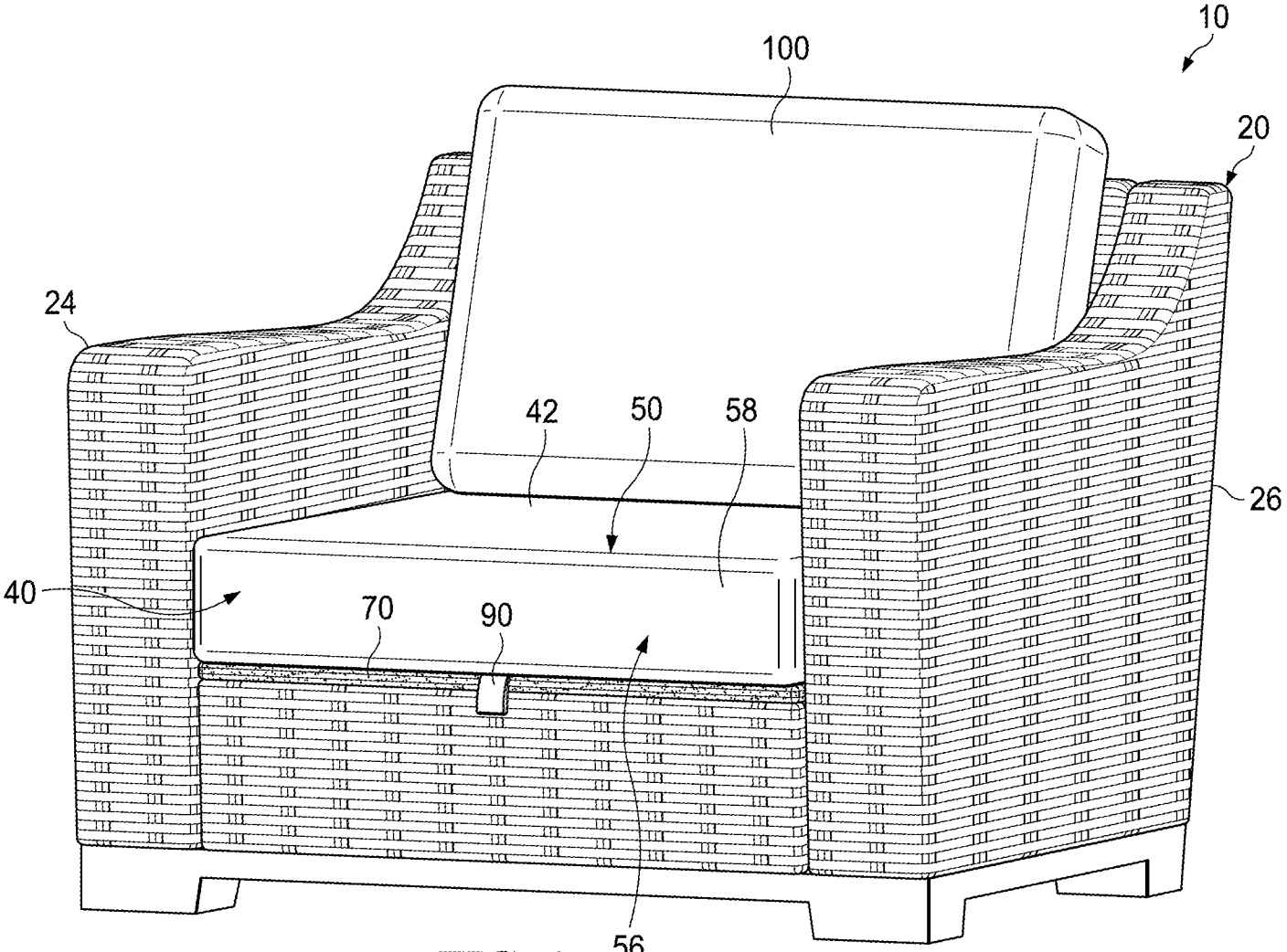
FIG. 1 is a perspective view of a chair of the invention shown in a seating configuration.
Figure 2:
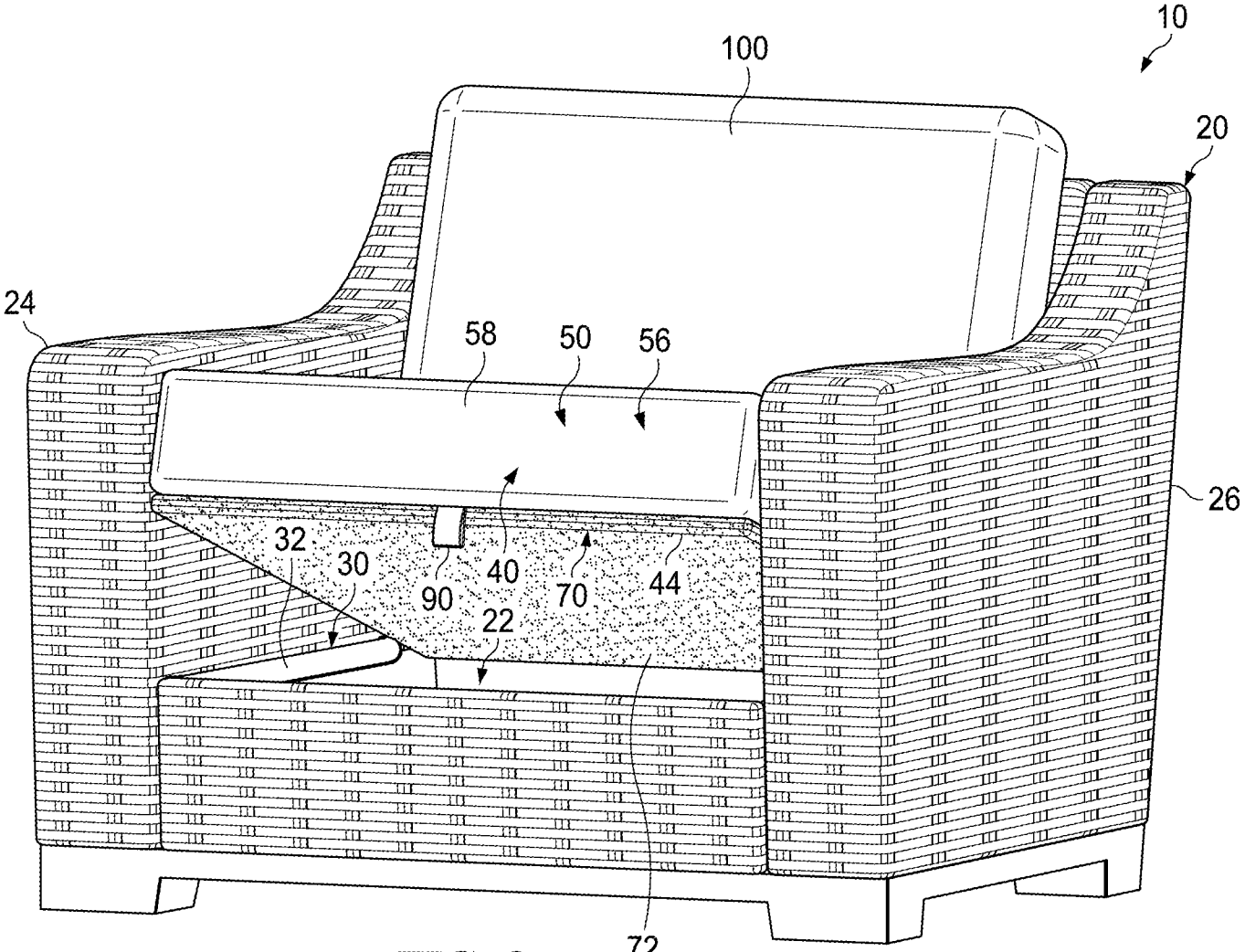
FIG. 2 is a perspective view of the chair of FIG. 1 wherein a seat assembly is lifted to expose a cushion receiving receptacle.
Figure 3:
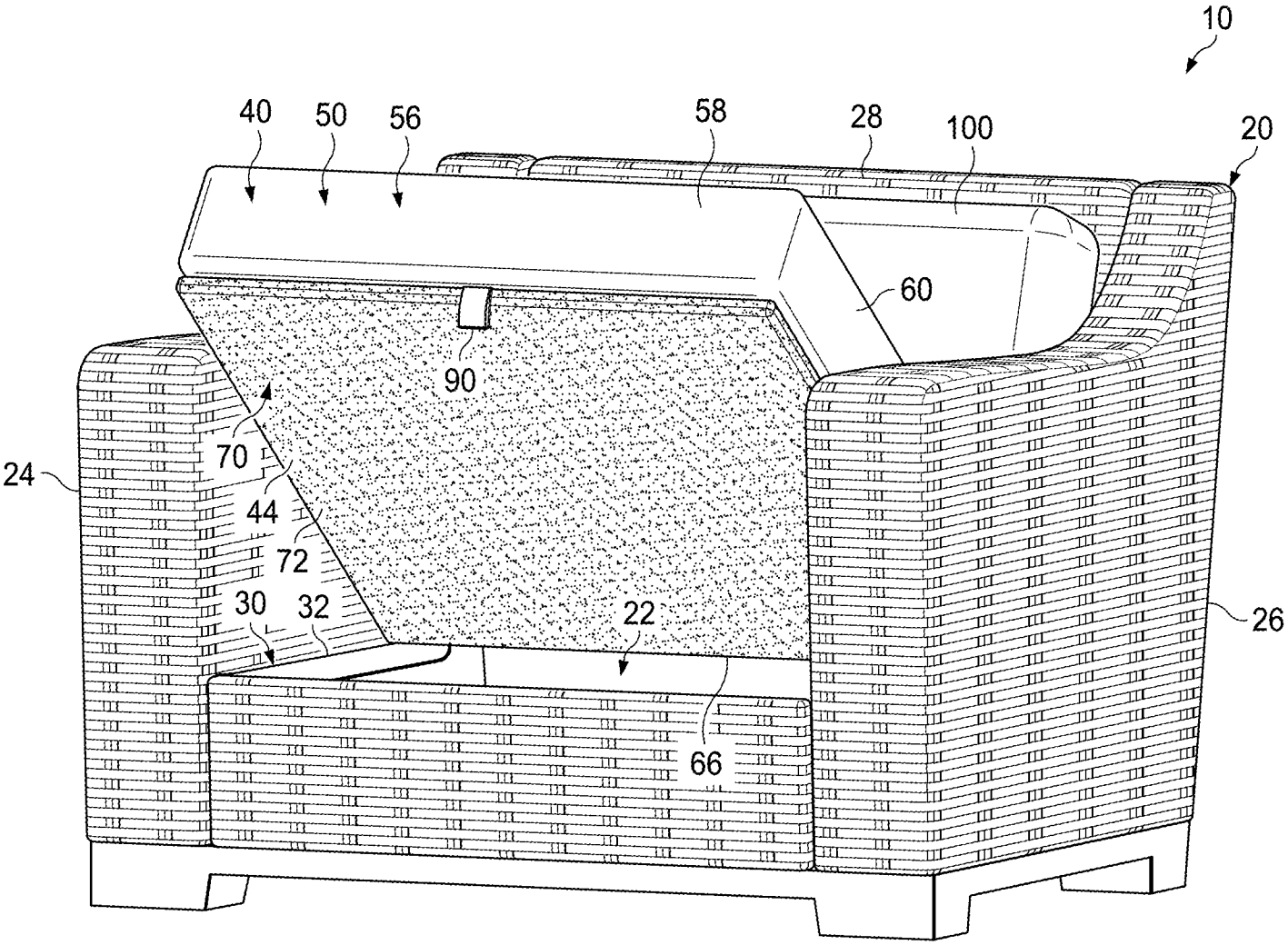
FIG. 3 is a perspective view of an alternate embodiment of the chair of FIG. 1 showing a seat cushion having a non-rectangular shape.
Figure 4:
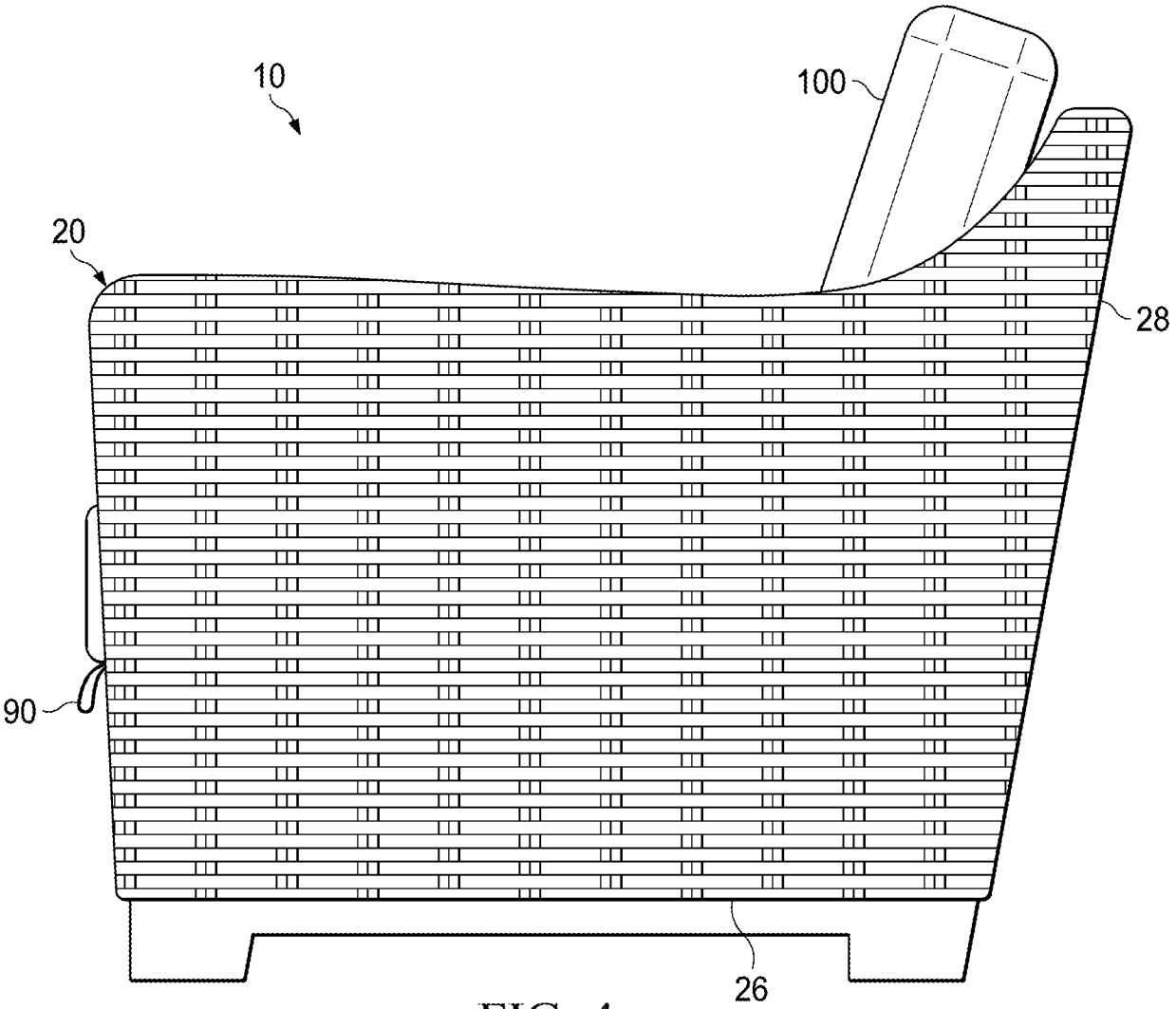
FIG. 4 is a side elevation view of the furniture of FIG. 1.
Figure 5:
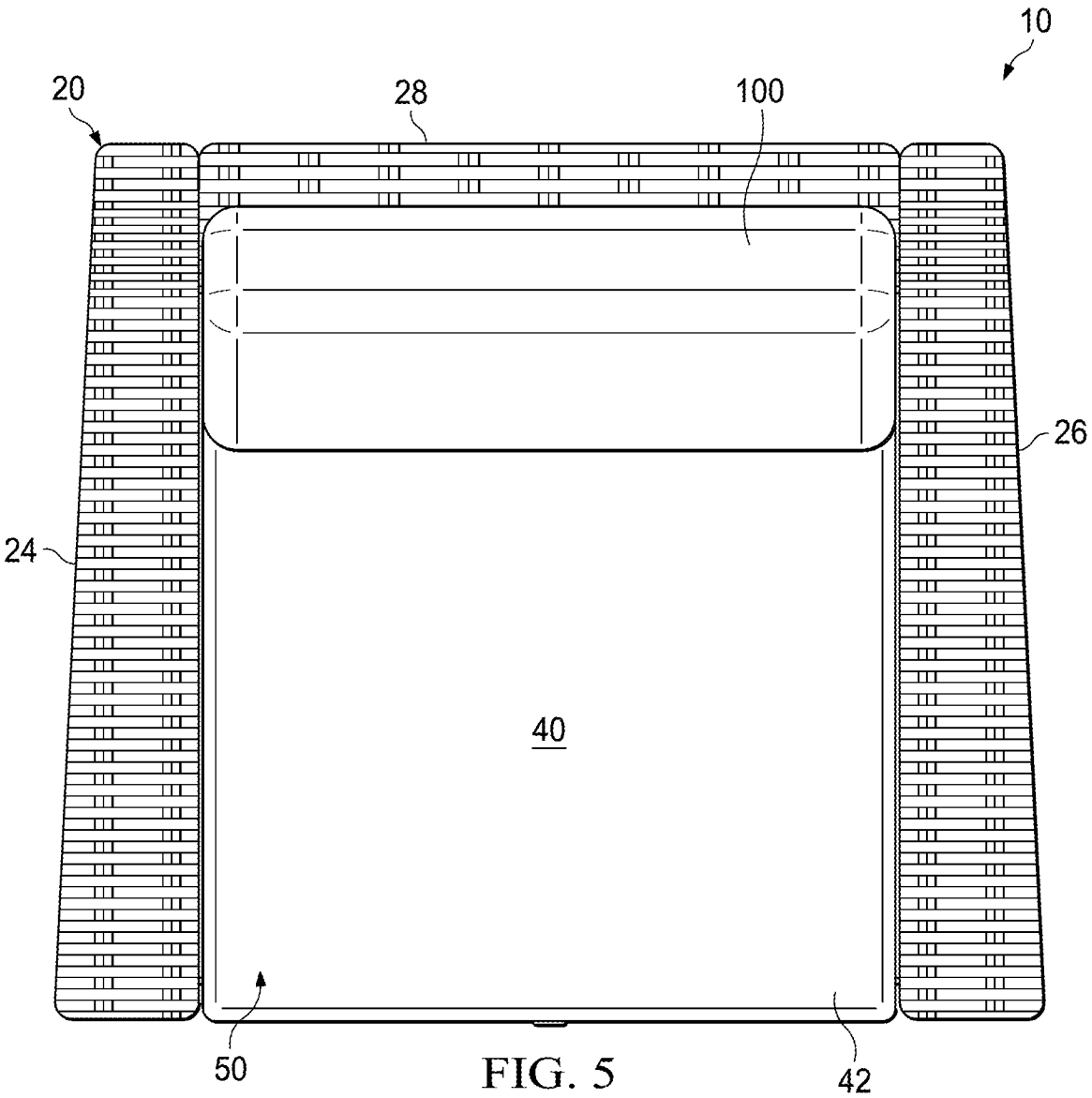
FIG. 5 is a plan view of the furniture of FIG. 1.
Figure 6:
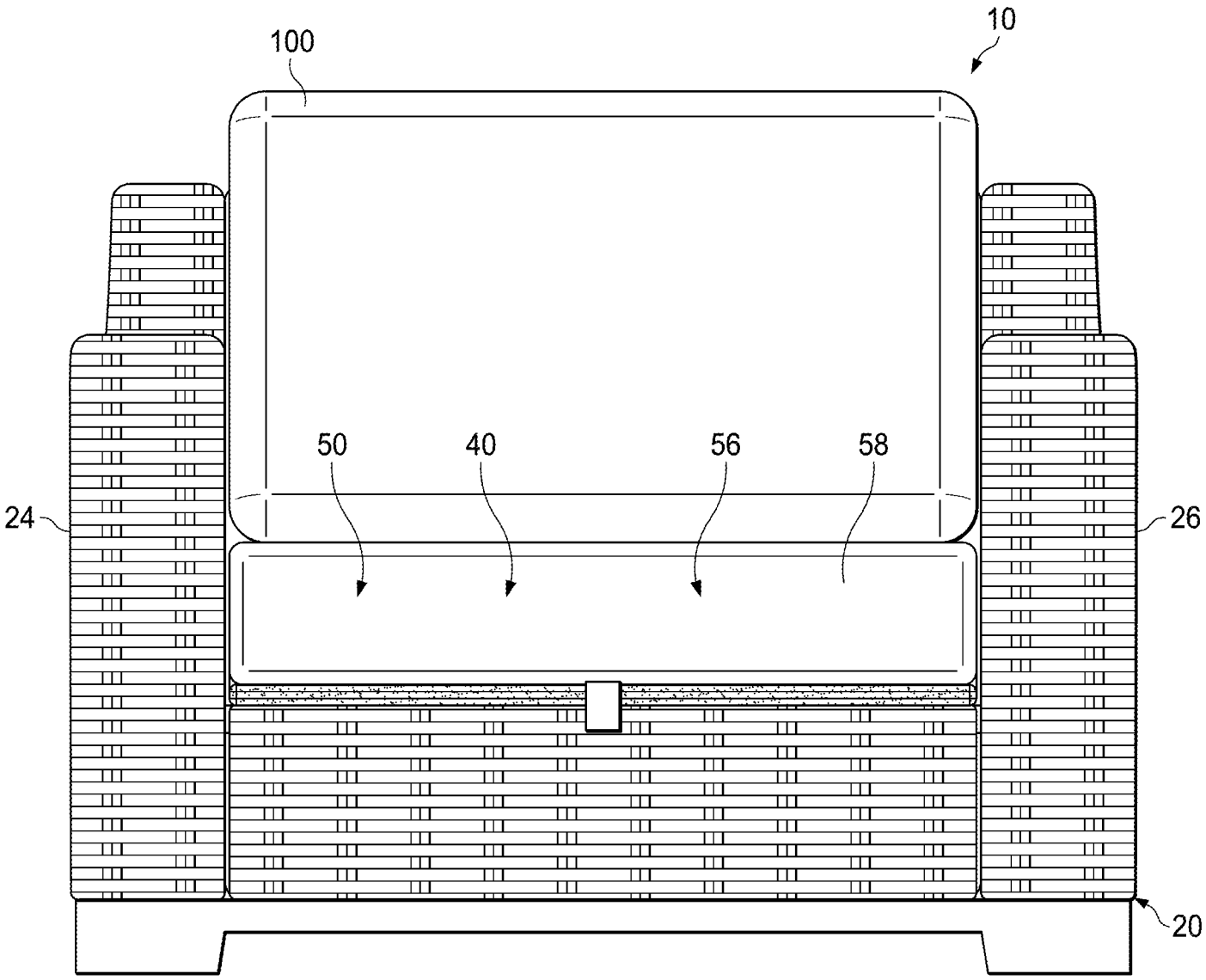
FIG. 6 is a front elevation view of the furniture of FIG. 1.

Referring now to the figures, shown is a flip cushion furniture designated generally 10. Flip cushion furniture 10 includes a frame 20. In one embodiment, frame 20 defines a cushion receiving receptacle 22 (FIGS. 2, 3, 11, 12). In one embodiment, cushion receiving receptacle 22 is rectangular. Frame 20 preferably defines first side structure 24 and second side structure 26. Frame 20 preferably defines back portion 28.

Figure 11:
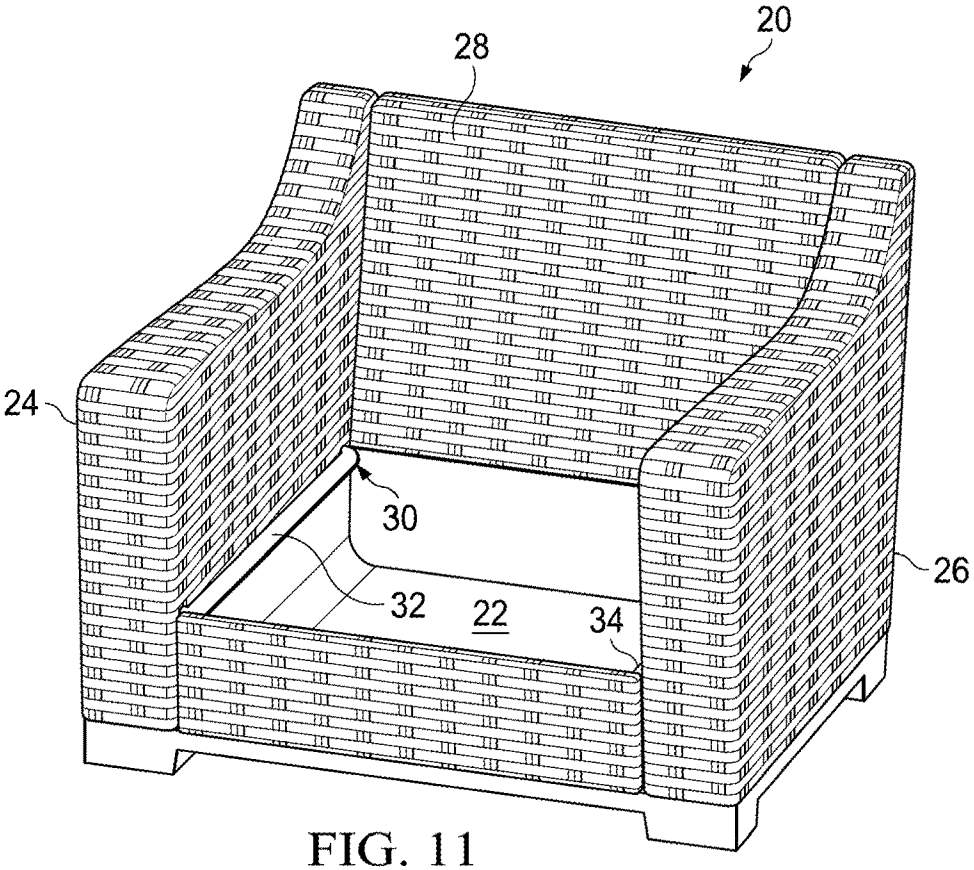
FIG. 11 is a perspective view of a frame of the furniture of FIG. 1.
Figure 10:
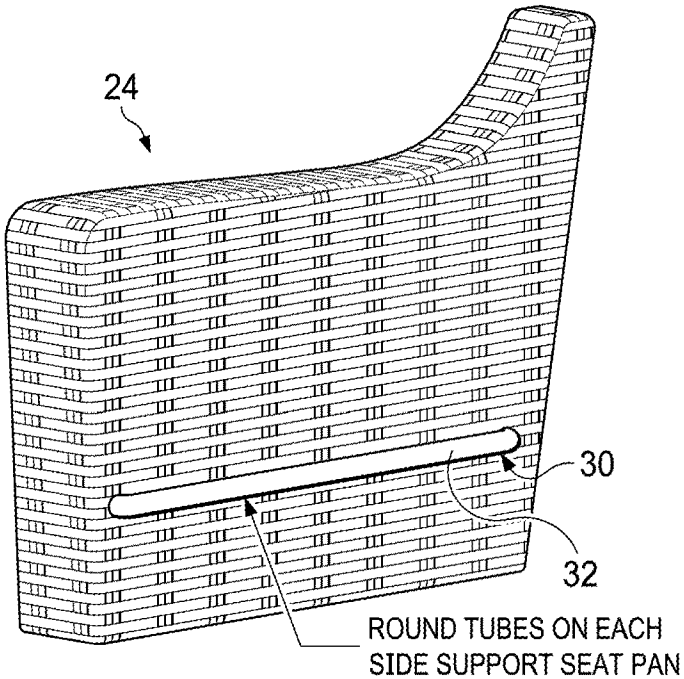
FIG. 10 is a perspective view of a first side structure of a frame of the furniture of FIG. 1.
Figure 12:
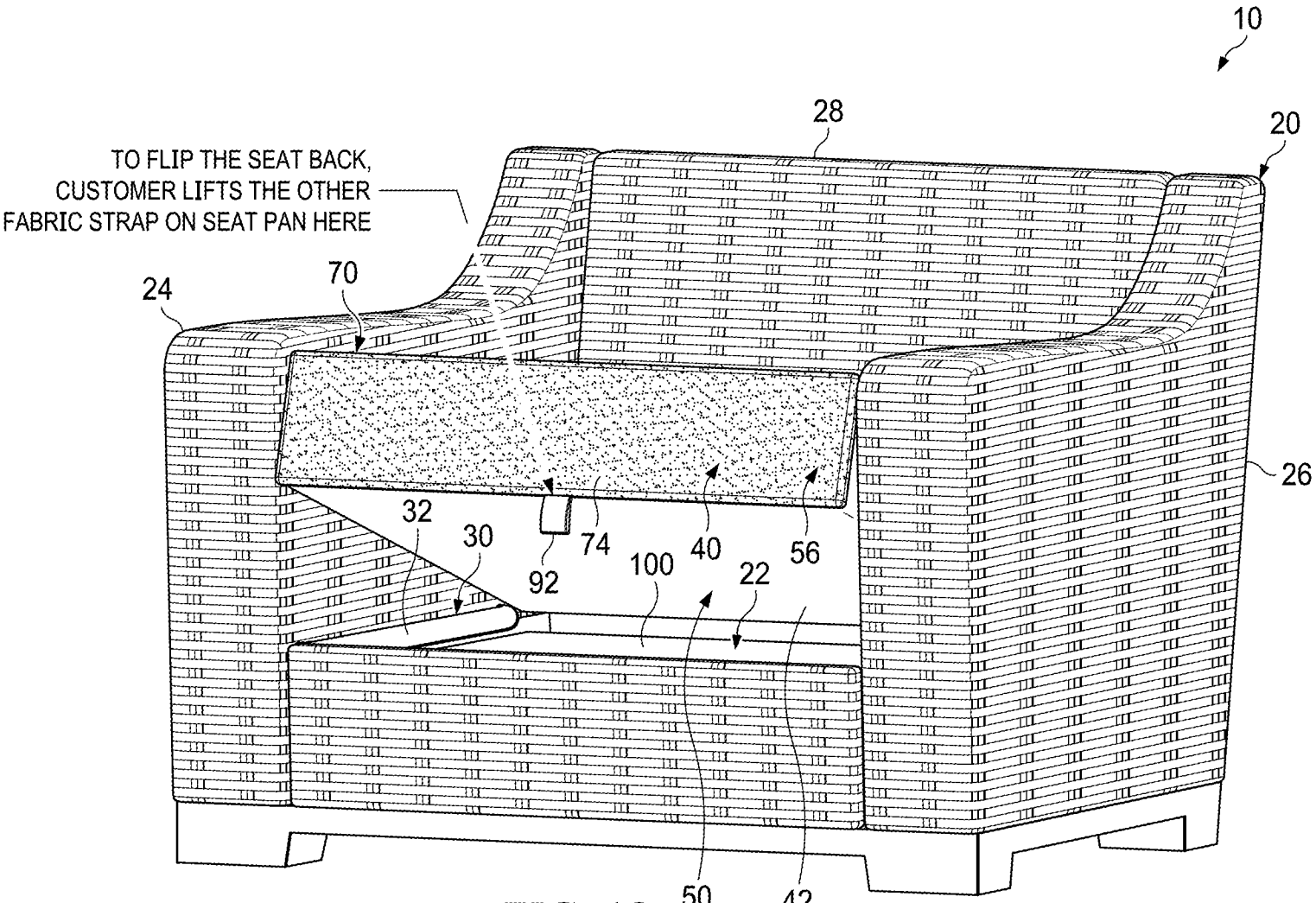
FIG. 12 is a perspective view of the furniture of FIG. 1 configured in a cover configuration wherein the seat assembly is lifted to expose a back cushion stored in a cushion receiving receptacle.

Seat pan support 30 is provided on frame 20. In one embodiment, seat pan support 30 has a first seat pan support piece 32 and a second seat pan support piece 34 (FIG. 11). In one embodiment, first seat pan support piece 32 is located on first side structure 24 and second seat pan support piece 34 is located on second side structure 26.

Figure 7:
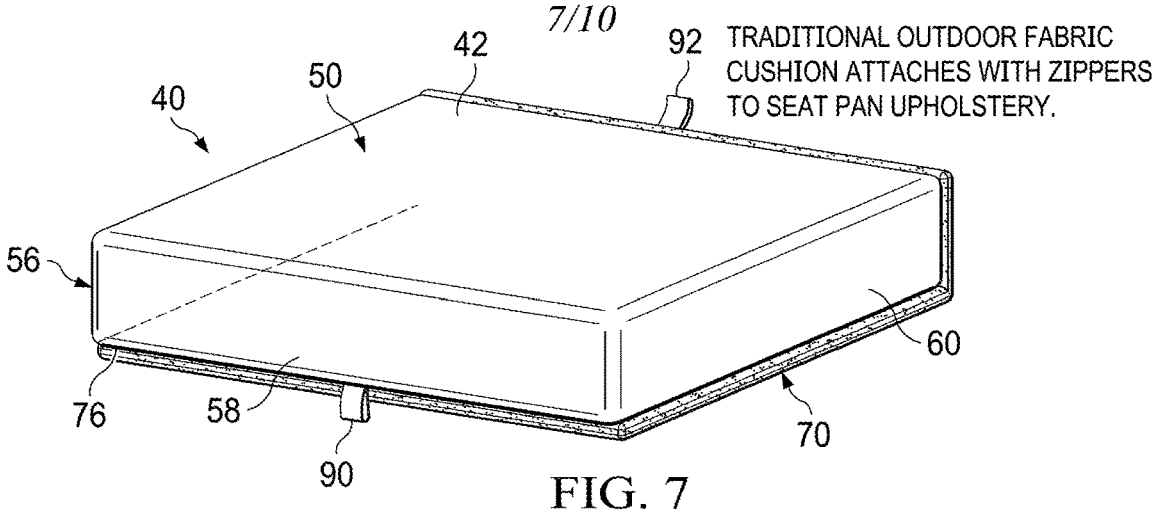
FIG. 7 is a perspective view of a seat assembly of the furniture of FIG. 1, wherein the seat assembly is shown cushion side up with the cushion attached to seat pan upholstery with zippers.
Figure 8:
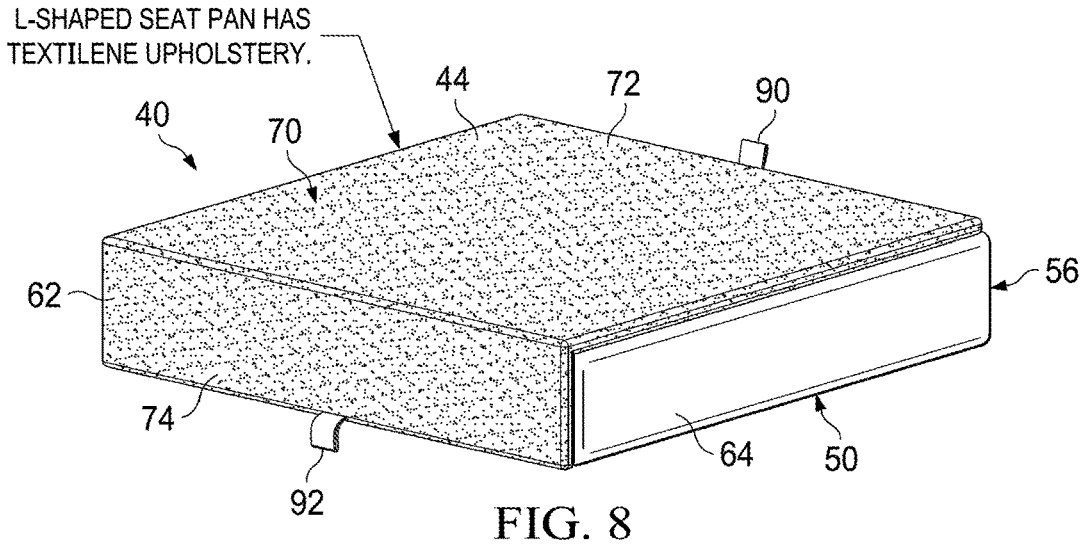
FIG. 8 is a perspective view of a seat assembly of the furniture of FIG. 1, wherein the seat assembly is shown seat pan side up.
Figure 9:
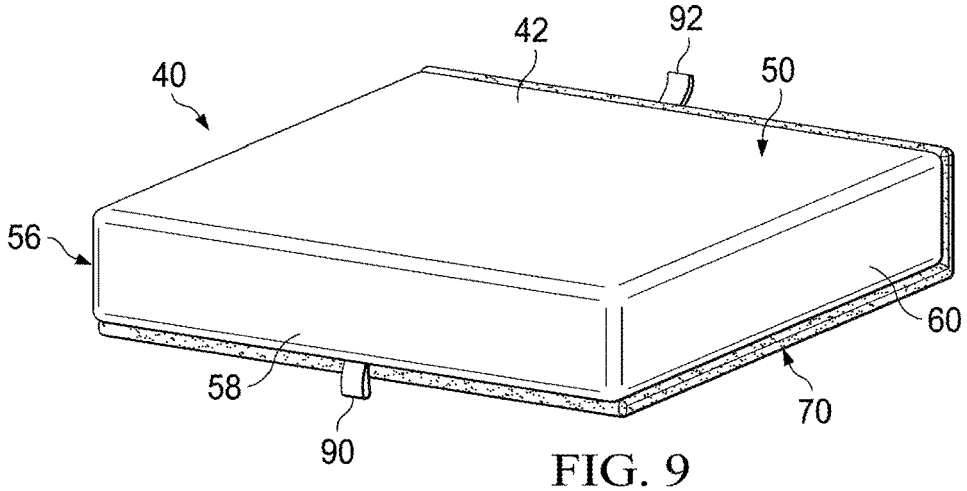
FIG. 9 is a perspective view of a seat assembly of the furniture of FIG. 1, wherein the seat assembly is shown cushion side up.

As best seen in FIGS. 7-9, seat assembly 40 includes a seat cushion 50 and a seat pan 70. Seat assembly 40 has a first surface 42 and a second surface 44. First surface 52 is a portion of seat cushion 50 sized for supporting a sitting person.

Seat cushion 50 preferably includes a side surface 56 between first surface 42 and second surface 44. In one embodiment, side surface 56 defines a first side portion 58, a second side portion 60, a third side portion 62, and a fourth side portion 64. In one embodiment, side surface 56 defines a first side portion 58 and a shaped opposite side portion 66 (FIG. 3) that is opposite first side portion 58.

Seat pan 70 has a first seat pan section 72 on one of first surface 42 and second surface 44 of seat assembly 40. Seat pan 70 has a second seat pan section 74 (FIGS. 8, 12, 13) that covers one of first side portion 58, second side portion 60, third side portion 62, fourth side portion 64, and opposite side portion 66. In one embodiment, first seat pan section 72 and second pan section 74 are joined together. In one embodiment, first seat pan section 72 covers one of first surface 42 and second surface 44 of seat assembly 40 with zipper 76 (FIG. 7). In one embodiment, seat pan 70 defines an outer surface 78 that is covered with upholstery 80.

First grab member 90 is affixed to seat pan 70. Second grab member 92 is affixed to seat pan 70 opposite first grab member 90. In one embodiment, first grab member 90 and second grab member 92 are fabric straps. In one embodiment, first grab member 90 is affixed to first seat pan section 72 and second grab member 92 is affixed to second side portion 60 of seat pan 70.

Back cushion 100 may be provided for locating adjacent to back portion 28 of frame 20.

In use, a method of configuring a piece of outdoor furniture 10 from a seating configuration (e.g., FIG. 1) to a cover configuration (e.g., FIG. 13) includes the following steps. A first grab member 90 is grasped on seat assembly 40. Seat assembly 40 preferably has a seat cushion 50 wherein seat cushion has a first surface 42 facing upwardly, a second surface 44 facing downwardly, a first side portion 58 facing outwardly, and a second side portion 60 facing a back portion 28 of frame 20. A second surface 54 and second side portion 60 are covered with a protection surface.

In one embodiment, seat assembly 40 (see, e.g., FIGS. 2, 3) is raised to expose a cushion receiving receptacle 22. Back cushion 100 is removed and located within cushion receiving receptacle 22. Preferably, the cover surface comprises a rigid seat pan 70.

Figure 13:
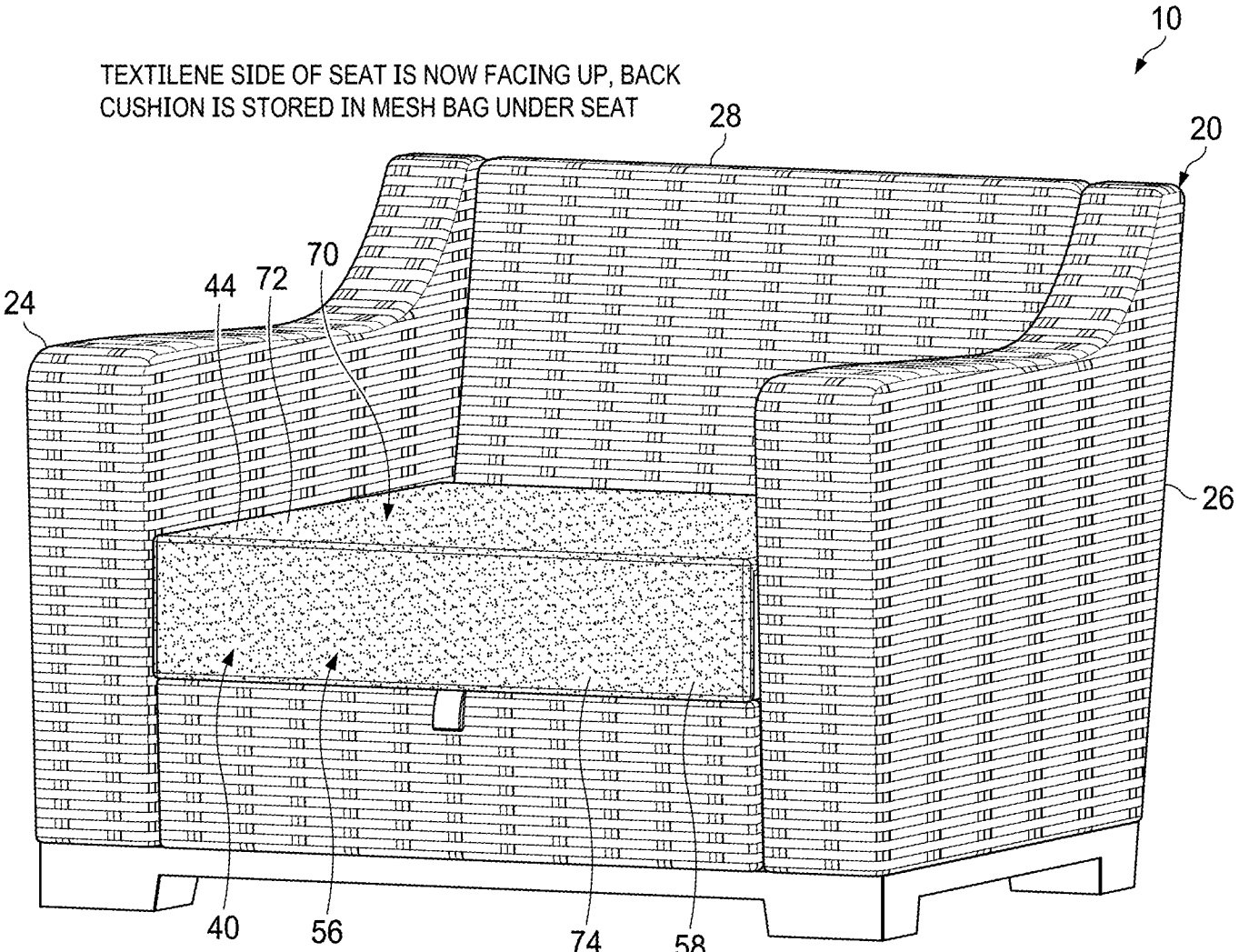
FIG. 13 is a perspective view of the furniture of FIG. 1 configured in a cover configuration.

Seat assembly 40 is positioned in a horizontal orientation on a seat pan support 30 (see, e.g., FIG. 13). Seat assembly 40 is oriented such that previously upwardly facing first surface 42 is oriented in a downwardly facing orientation, previously outwardly facing first side portion 58 is oriented to face back portion 28 of frame 20, and previously backwardly facing side portion 62 is oriented to be outwardly facing.

The outdoor furniture 10 may be reconfigured from a cover configuration (e.g., FIG. 13) to a seating configuration (e.g., FIG. 1) by grasping second tab member 92 on seat assembly 40. Seat assembly 40 has first surface 42 facing downwardly, second surface 44 is facing upwardly. Seat cushion 50 has a first side portion 58 facing back portion 28 of frame 20, and third side portion 62 facing outwardly. Second surface 44 and second side portion 62 are covered with a cover surface, e.g., with seat pan 70.

In one embodiment, seat assembly 40 is lifted to expose cushion receiving receptacle 22 (see FIG. 12) wherein cushion receiving receptacle 22 contains back cushion 100. Back cushion 100 is removed from cushion receiving receptacle 22.

Seat assembly 40 is located in a horizontal orientation on seat pan support 30. Seat assembly 40 is configured such that previously upwardly facing second surface 44 is oriented in a downwardly facing orientation and previously downwardly facing first surface 42 is oriented in an upwardly facing orientation (see FIG. 1). Previously back facing first side portion 58 is outwardly facing (see FIG. 1).

Preferably, first surface 42 of seat assembly 40 is compressible for providing a comfortable seating surface for a person. Additionally, first side portion 58 of seat cushion 50 is preferably compressible for comfortably accommodating a person.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A flip-cushion furniture piece comprising:

a frame;

a seat pan support on said frame;

a seat assembly having a first surface and a second surface, said first surface comprised of a seat cushion, said second surface comprised of a first seat pan section;

said first seat pan section supported by said seat pan support when said seat assembly is oriented with first surface facing up and second surface facing down;

a first grab member affixed to said first seat pan section;

a second grab member affixed to a second seat pan section opposite said first grab member, said second seat pan being a rigid section covering a side portion of the seat assembly.

2. The furniture piece according to claim 1 wherein:

said frame defines a cushion receiving receptacle.

3. The furniture piece according to claim 2 further comprising:

a back cushion for locating adjacent a back portion of said frame;

wherein said back cushion is sized to be received within said cushion receiving receptacle.

4. The furniture piece according to claim 1 wherein:

said frame defines a first side structure and a second side structure.

5. The furniture piece according to claim 4 wherein:

said seat pan support has a first seat pan support piece and a second seat pan support piece, wherein said first seat pan support piece is on said first side structure and said second seat pan support piece is on said second side structure.

6. The furniture piece according to claim 1 wherein:

said frame defines a back portion.

7. The furniture piece according to claim 6 further comprising:

a back cushion for locating adjacent said back portion of said frame.

8. The furniture piece according to claim 1 wherein:

said first seat pan section and said seat cushion are joined together with a zipper.

9. The furniture piece according to claim 1 wherein:

said first seat pan section defines an outer surface that is covered with upholstery.

10. The furniture piece according to claim 1 wherein:

said first grab member and said second grab member are fabric straps.

11. A method of configuring a piece of outdoor furniture from a seating configuration to a cover configuration comprising the steps of:

grasping a seat assembly that is supported by a frame, said seat assembly having a first side comprising a seat cushion facing upwardly, said seat assembly having a second surface facing downwardly, said seat cushion first side surface facing outwardly and a second side surface facing a back portion of a frame, wherein said second surface and said second side surface are covered with a cover;

locating said seat assembly in a horizontal orientation on a seat pan support, wherein said previously upwardly facing first surface is oriented in a downwardly facing orientation and wherein said previously outwardly facing first side surface is oriented to face said back portion of said frame such that said cover is upwardly and outwardly facing and said cushions are beneath said cover.

12. The method according to claim 11 wherein:

said cover comprises a rigid seat pan.

13. The method according to claim 11 further comprising:

lifting said seat assembly to expose a cushion receiving receptacle;

locating a back cushion into said cushion receiving receptacle.

14. A method of configuring a piece of outdoor furniture from a cover configuration to a seating configuration comprising the steps of:

grasping a seat assembly having a first surface and a second surface, said first surface comprising a seat cushion facing downwardly, said second surface comprising an seat pan facing upwardly, said seat cushion having a first side surface facing a back portion of a frame, and a second side surface facing outwardly, wherein said second surface and said second side surface are covered with a cover;

locating said seat assembly in a horizontal orientation on a seat pan support, wherein said previously upwardly facing second surface is oriented in a downwardly facing orientation and wherein said previously back facing first side surface is outwardly facing;

wherein said first surface of said seat cushion is compressible for providing a comfortable seating surface for a person;

wherein said first side surface of said seat cushion is compressible for comfortably accommodating a person.

15. The method according to claim 14 further comprising:

lifting said seat assembly to expose a cushion receiving receptacle, said cushion receiving receptacle containing a back cushion;

removing said back cushion from said cushion receiving receptacle.

* * * * *